US005450840A

United States Patent [19]

Kozdas

[11] Patent Number: 5,450,840

[45] Date of Patent: Sep. 19, 1995

[54] STOVE-TOP GUARD

[76] Inventor: Anthony B. Kozdas, R.R. #2,, Stirling, Ontario, K0K 3E0, Canada

[21] Appl. No.: 304,595

[22] Filed: Sep. 12, 1994

Related U.S. Application Data

[63] Continuation of Ser. No. 122,695, Sep. 17, 1993, abandoned.

[51] Int. Cl.[6] ..... F24C 3/12

[52] U.S. Cl. ..... 126/42; 126/211

[58] Field of Search ..... 126/214 D, 201, 42, 126/211

[56] References Cited

U.S. PATENT DOCUMENTS

| | | | |
|---|---|---|---|
| 697,185 | 4/1902 | Walker | 126/201 |
| 2,778,356 | 1/1957 | Pugach . | |
| 3,043,289 | 7/1962 | Fox . | |
| 3,898,975 | 8/1975 | Kemp | 126/42 |
| 4,517,955 | 5/1985 | Ehrlich . | |
| 4,527,540 | 7/1985 | Ryan . | |
| 4,616,628 | 10/1986 | Ratelband | 126/121 |
| 4,625,708 | 12/1986 | Beall . | |
| 4,836,181 | 6/1989 | Saga . | |
| 4,922,888 | 5/1990 | Pryan et al. | 126/42 |
| 5,076,255 | 12/1991 | Harrison . | |

FOREIGN PATENT DOCUMENTS

| | | |
|---|---|---|
| 1223493 | 6/1987 | Canada . |
| 1230790 | 12/1987 | Canada . |
| 2020754 | 7/1990 | Canada . |
| 0389760A3 | 2/1990 | European Pat. Off. . |
| 2452064 | 11/1980 | France . |
| 770327 | 3/1957 | United Kingdom . |
| 1281275 | 7/1972 | United Kingdom . |

*Primary Examiner*—Carl D. Price
*Attorney, Agent, or Firm*—Robert M. Phipps

[57] ABSTRACT

A stove-top guard for attachment to a cooking stove or range, to prevent small children, and others, from reaching surface burner units or hot cooking containers on the stove-top surface, is described. The guard includes a venting system, which dissipates heat, and thus prevents the guard from becoming a hazard itself.

5 Claims, 2 Drawing Sheets

STOVE-TOP GUARD

This is a continuation of application Ser. No. 08/122,695, filed Sep. 17, 1993 abandoned.

FIELD OF INVENTION

The invention relates to a stove-top guard to prevent small children, and others, from reaching the stove burners or cooking containers located on the burners. More specifically, the invention relates to a stove-top guard which is provided with a venting system which allows any heat which builds up in the guard, while the stove is in use, to be dissipated. Additionally, in one embodiment of the invention, the surface of the guard, which is in contact with the stove, is coated with a non heat-conducting material to slow the transfer of the heat from the stove to the guard, when the stove is in use.

BACKGROUND AND PRIOR ART

A number of guards or barriers have been proposed in the prior art to protect small children, and others, from heated surfaces of cooking ranges or stoves. Canadian Patent 1,230,790 provides one such example of a safety device apparatus for use on a stove or a range. The device of this prior art is readily moveable to provide access to the cooking surface. However, such a device would have little practical use if it must be removed or moved into an "out of the way position" in order to use the range or stove.

Another such device is found in Canadian Patent Application 2,020,754. This patent application describes a rigidly and firmly attached shield to a conventional stove by using attachment screws, already provided for connecting the oven to the stove front wall, to attach the shield to the stove. According to this application, the shield is spaced from the stove surface, such that it does not tend to become hot (due to heat conduction from the stove surface).

The problem of the stove guards themselves becoming hot, and thus becoming a hazard, was also addressed in U.S. Pat. No. 5,076,255. It is respectfully submitted, however, that the prior art does not provide a stove-top guard or barrier, which would not become heated to a degree, which could be injurious if a small child were to make contact with the barrier. For example, U.S. Pat. No. 5,076,255 uses a clamping assembly to attach the barrier to the stove-top. Such a clamping assembly itself would become heated while the stove is in use. Furthermore, it is submitted that neither of the prior art references noted above, which disclose the problem of the barriers themselves becoming heated when the stove is in use, would remain cool if the stove were in use for an extended period of time.

Therefore, there is a need to provide a barrier or guard for a stove-top or a range, which actively addresses the question of heat dissipation so that the barrier itself does not become a hazard when the stove or range is in use. The present invention is thus directed to a novel stove-top guard, which comprises a venting system, which vents any heat which is transferred to the guard from the stove, when in use. The guard of the present invention can also comprise a means to reduce or slow any transfer of heat to the guard from the stove, when in use.

SUMMARY OF INVENTION

The present invention therefore is directed to a stove-top guard comprising a venting system, which is adapted to dissipate any heat which is transferred from the stove, when in use, to the guard. The present invention is further provided with means, which slow the transfer of heat from the stove to the guard.

According to one embodiment of the present invention, there is provided a stove-top guard for the top of a stove or range, along one or more sides thereof, comprising:

horizontal rails comprising a venting system to dissipate heat from the guard when the stove is in use; and vertical support members attached to the rails and adapted to provide attachment means to the stove-top.

In one embodiment of the present invention, the rails are hollow and are open at the top and bottom to allow air to flow through the hollow rails, thus cooling the rails. In a further embodiment of the present invention, the venting system comprises a plurality of spaced apart holes or grooves on the front face of the rail to ensure air circulation in and around the rails in order to dissipate any heat which accumulates in the rails.

In another embodiment of the present invention the rails are hollow and the vents are placed within the inwardly curved portions of the curved-shaped rail and are spaced apart horizontally from each other so that only a part of the vents overlap vertically. This placement of the vents first increases the movement of the air and also exposes more of the inside surface of the hollow rail to the moving air.

According to a further embodiment of the present invention the stovetop guard further comprises horizontal wires attached to the backside of the horizontal rails wherein the wires and the attachment means are provided with a coating of a non heat-conducting material to slow the transfer of the heat from the stove, when in use, to the guard.

DESCRIPTION OF THE PREFERRED EMBODIMENT

Figure 1:
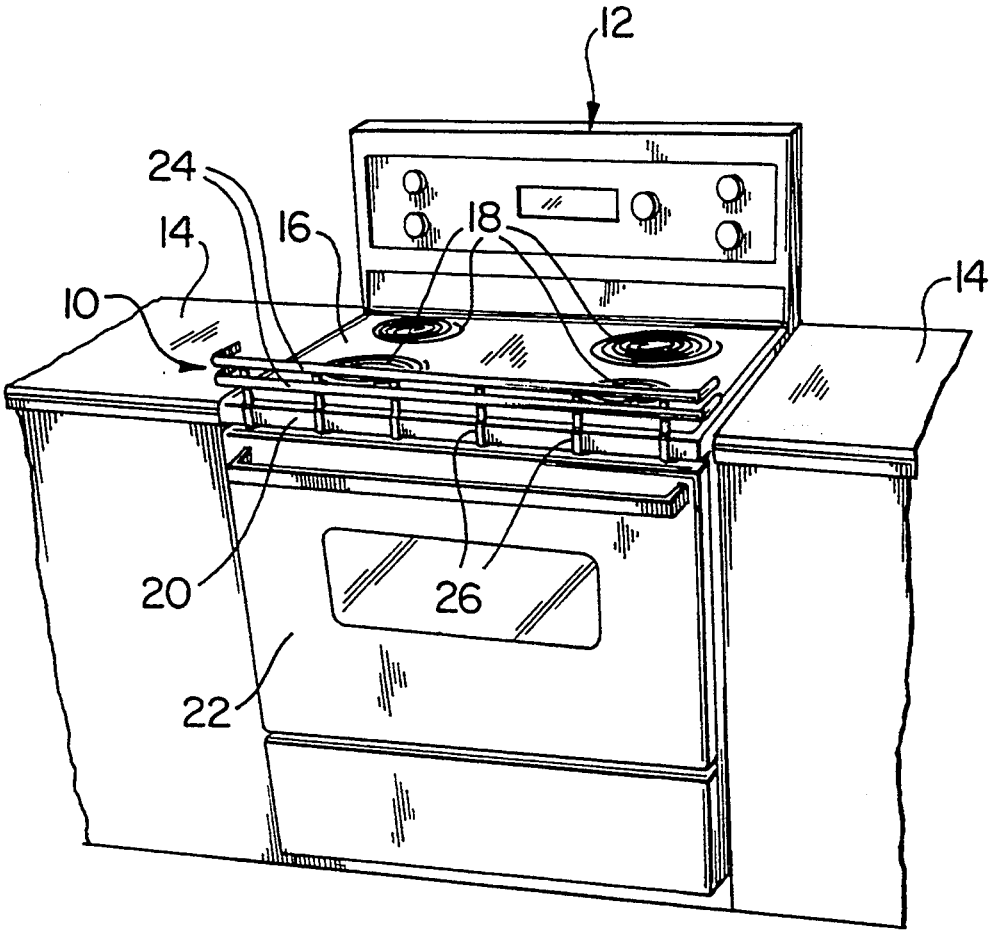
FIG. 1 is a fragmented, perspective view of the stove-top guard mounted onto a stove or range.

The stove-top guard is shown in FIG. 1 in a typical operative environment, attached to the front of a stove-top or range top and depicted generally by the reference numeral 10. The stove is a typical cooking range depicted by the reference numeral 12. For illustrative purposes, the stove or range is shown as installed between two counters generally referred to by reference numeral 14. It would however be obvious that the range could be installed at the end of a counter. In addition, the stove-top guard of the present invention can also be used in conjunction with a cook top either in a counter installed against a wall or in a central island in a kitchen.

The stove-top guard is depicted in FIG. 1 as extending along the entire front surface of the stove or range and containing partial side units. These partial side units could be of varying length provided that they provide adequate protection from the stove from the side. Of course it would be obvious that if the stove were positioned at the end of a counter or if the stove guard is to be used in conjunction with a cook top in a central island, side portions may also be installed on any exposed sides of the stove or range. In the example where the stove-top guard is to be used in conjunction with a stove-top or cook top in a central island, it would be preferred to provide the stove-top guard along all four sides of the cook top.

Common to most cook stoves or ranges is a top portion 16 on which is mounted the conventional burners 18. The top portion of the cooking range has a front surface 20 which projects above the oven door 22. As will be described in more detail later, the stove-top guard is connected to the upper portion of the cooking range by way of an attachment means adapted to fit under and attach to the upper portion of the cooking range.

Figure 2:
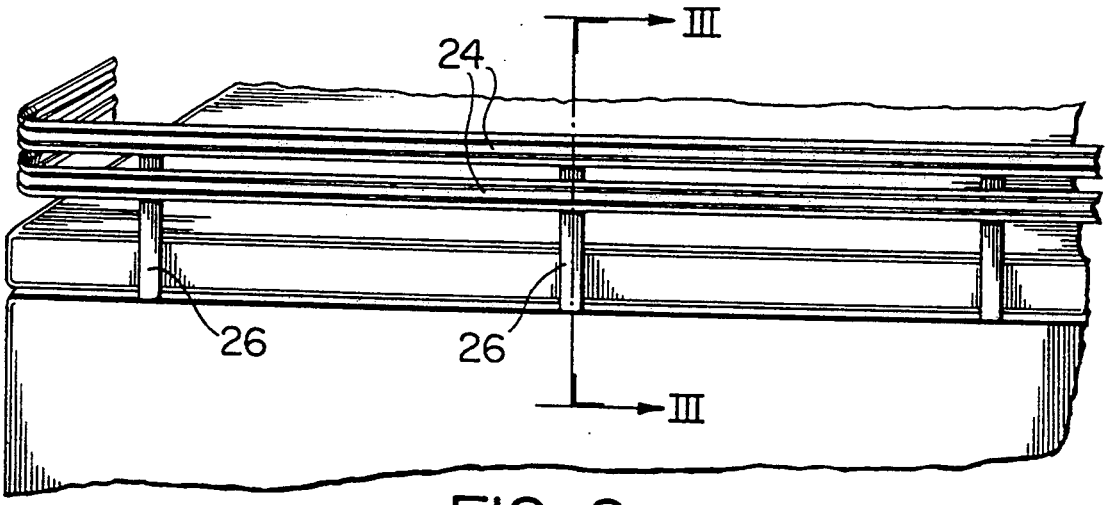
FIG. 2 is a fragmentary, enlarged partial front view of the stove-top guard as mounted onto a stove or range.

A partial closeup view of the stove-top guard is shown in FIG. 2. The stove-top guard comprises a plurality of horizontal rails 24, which run the full length of the front end of a conventional stove-top and preferably also run at least a portion of the way extending down the sides of the stove or range, as noted above.

The rails 24 are supported and maintained in place by vertical support members 26, which not only support the vertical rails, but also are adapted to provide an attachment means to attach the stove-top guard to the upper portion of the conventional stove or range. The vertical and horizontal members are connected by any means known in the art. In one embodiment of the present invention, the horizontal rails 24 and the vertical support members 26 are connected by spot welding. It would also be possible to connect these pieces using screws or other type of connecting means.

Figure 3:
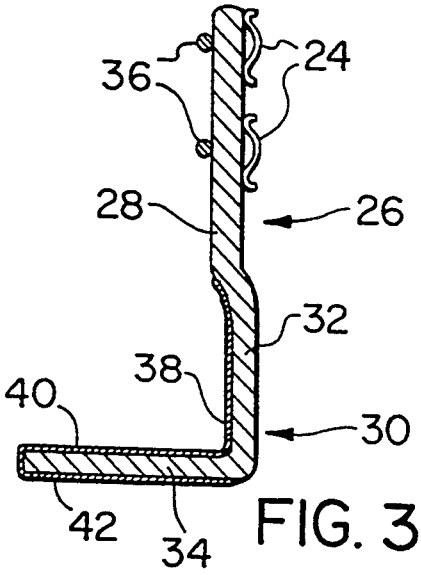
FIG. 3 is a cross-sectional view of the guard taken along line III in FIG. 2.

The vertical support member 26 is comprised of two regions as shown in FIG. 3. Region 28 is the support region, on which the vertical rails 24 are attached. The second region, generally indicated by the reference numeral 30, is the attachment region, which provides attachment of the stove-top guard to the upper portion of the stove or range. This region is divided into two sections, a first section, 32, which is adapted to wrap around the front portion, 20, of the stove-top and a second section, 34, which is adapted to fit under the top portion of the stove in the gap between the stove-top and the oven door.

Section 34 is physically attached to the stove when the stove-top guard is installed. Attachment methods, which have been disclosed in prior art stove guards, could be used in the present invention. For example, U.S. Pat. No. 4,517,955 (incorporated herein by reference) provides permanent magnets to attach the stove guard to the stove. Furthermore, Canadian Patent Application 2,020,754 (incorporated herein by reference) uses attachment screws already present on conventional stove-oven units for mounting a protective shield at the front of the stove or range. Any type of method would be suitable for attachment of the stove-top guard of the present invention to the front and/or sides of the stove. In one embodiment of the present invention, the stove-top guard is attached to the stove by a clamping device wherein section 34 of the vertical support member is clamped or clipped to the inside portion of the front end of the stove 20. Purely from a safety point of view a permanent attachment is preferred, which ensures that the stove-top guard is not easily removed, thus exposing the hot stove or range and cooking pots and pans to small children, and others.

A further component of the stove-top guard, in one embodiment thereof, includes a taught steel-type wire 36, which is placed on the back side of the vertical support member 26. The taught steel-type wire act as a spacer between the pots and the guard and thus aid to reduce transfer of heat from the cooking pots to the stove-top guard. If a cooking pot or pan comes in contact with the stove-top guard, it will thus contact the wire. This wire is preferably coated with a non-heat conducting coating which functions to slow the transfer of the heat from the cooking pots or pans to the stove-top guard and thus aid in keeping the stove-top guard below a temperature which would be hazardous if touched. The wires can be made of any type of material, for example, metals, metal alloys, metal and plastic mixtures or ceramic materials. In one embodiment of the invention, the wire is prepared from stainless steel.

The non-heat conducting coating, referred to above, is also found on the attachment means 30 of the vertical support member and is preferably coated on all surfaces, which would come into contact with the cooking stove. For example, the coating preferably would be placed on the back surface of section 32 (38) and the upper 40 and lower 42 sides of sections 34. Although not shown in FIG. 3, it may also be advantageous to place this non-heat conducting coating on the front surface of section 32 to again slow the heating of the stove-top guard.

The non-heat conductive coating in one embodiment of the present invention is a plastic material. Any other suitable material could be used which would function as a non-heat conductive material. Preferably the material is coated onto the stove-top guard at the places noted above by dip-coating. Spraying or painting would also be suitable means for applying the non-heat conductive coating.

In FIG. 3, the steel-type wires are shown to be positioned opposite the placement of the horizonal rails 24, which are attached generally to the front of the support member 26. If a cooking pot or pan touches the stove-top guard, localized heating will occur at that point. As will be discussed below, the horizontal rails 24 are provided with a vent system, which will dissipate any heat which accumulates in the rail. Accordingly, if the steel-type wires do become heated as a result of a cooking pot or pan resting against them, the vent system in the horizontal rails will function to quickly dissipate the heat.

The accompanying drawings are shown with two horizontal rails on the stove-top guard, however, one or more rails are within the scope of the present invention. In considering the number of rails, consideration must be given to the overall height of the stove-top guard. The stove-top guard must be of sufficient height to ensure that it functions to provide a barrier to small children, and others, from reaching and touching the hot burners or cooking pots and pans, however, it must not be high enough to act as an impediment when the stove is in use. It has been found that a suitable height of the stove-top guard is in the range of 1.5 to 2 inches. It was found that this height range not only protected small children, and others, from the hot burners and cooking vessels, but also provided a barrier, which would inhibit cooking vessels from being pulled or tipped from the cooking surface, thus preventing spillage of their hot contents. It has been found that if the guard is over 2 inches, although functional, it becomes cumbersome and awkward to use. Also, if the guard is less than 1.5 inches it does not offer enough protection. A height of 1.5 to 1.875 inches is preferred.

In one embodiment of the present invention, the number of rails in the stove-top guard can range between 2 and 4. Consideration must however be given to the spacing between the rails to ensure proper air flow to again aid in the dissipation of heat, which may accumulate in the stove-top guard when the stove is in use.

Figure 4:
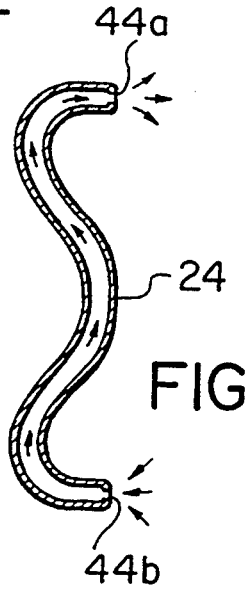
FIG. 4 is an enlarged cross-sectional view of one embodiment of the horizonal rails showing air flow through the vent system.

A further feature of the stove-top guard, which functions to keep the guard from becoming heated, and thus hazardous itself, is a venting system, which is provided on the horizontal rails of the stove-top guard. Two embodiments of this venting system is shown in detail in FIGS. 4 and 5. The venting system comprises a plurality of cooling vents 44, which are grooves, holes or apertures cut into the surface of the horizontal rails 24. The horizontal rails, as shown in FIG. 3 and FIG. 4, are curved-shaped, wherein it is preferred to place the vents at the bottom and top inner curve of the rail (this embodiment is not shown in FIG. 4). The vents of the present invention will aid, in conjunction with the shape of the rails, to ensure the circulation of air over the horizontal rails. A plurality of vents will be cut into the rails, periodically along the entire front surface of the rails. As such, any heat which is transferred to the rails will become quickly dissipated.

In one embodiment of the present invention the rails are hollow and the vents are cut into the front surface of the hollow rails. In this embodiment of the invention the vents are preferable placed in the bottom and top inner curve of the rails. In this embodiment the vents 44 occur in pairs, an upper and a lower vent, 44*a* and 44*b*, respectively, and are placed periodically throughout the length of the horizontal rail. The number of vents placed along the horizontal rail depends upon the metal used and the rate of heat dissipation needed to keep the stove-top guard from becoming hazardous itself. It is of course preferred to have more vents than less in order to ensure proper heat dissipation in the stovetop guard. However the overall strength of the rails and any weakening of the rails by numerous vents cut into the front of the rails, must also be a consideration. It was found preferred to have a pair of vents every 1 to 2 inches along the length the horizonal rail.

In the embodiments shown in FIG. 4, the rails are hollow and are open at the top and bottom to allow air to flow through the hollow rails, thus cooling the rails. The cool air is drawn in the bottom vent 44*b* passes through the hollow rail forcing any hot air accumulating in the rail to exit from the top vent 44*a*. As noted previously, the horizontal rail is curved-shaped. This shape, particularly with the bottom lip extending away from the stove, draws the cool air into the hollow rails, from an area away from the hot surface of the stove and therefore further aids in the cooling effect of the vents. Furthermore, the curve at the top end of the hollow rail aids to direct the escaping hot air away from the stove-top barrier.

Figure 5:
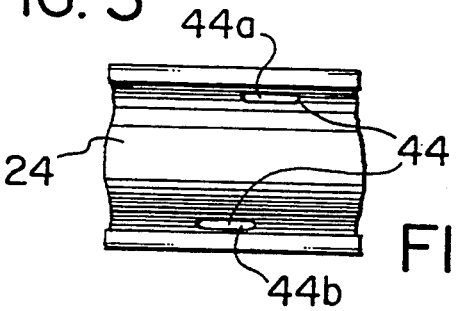
FIG. 5 is an enlarged view of one embodiment of the horizontal rail.

The placement of the cooling vents will also aid in the dissipation of any heat which accumulates in the stove-top guard. It is possible to place the two vents in an identical vertical placement such that vent 44*a* is placed above vent 44*b*. However, in one embodiment of the present invention, the cooling vents 44*a* and 44*b* are offset slightly, as shown in FIG. 5, such that the area which overlaps between the two is from about one quarter to one third of the size of the vents. This positioning of the vents increases the movement of the air through the hollow rails, and also increases the surface area of the hollow rails in which the air will pass over and therefore will increase the heat dissipation and the cooling effect of the vents.

Any suitable type of material can be used to construct the stove-top guard. Examples of such material include metals, plastics, metal alloys, metal and plastic mixtures, ceramic material.

The present invention has been described with regard to preferred embodiments. However, it will be obvious to persons skilled in the art that a number of variations and modifications can be made without departing from the scope of the invention as described in the following claims.

The embodiments of the invention in which an exclusive property or privilege is claimed are defined as follows:

1. A stove-top guard adapted for connection to a top portion of a stove along at least an outer front side of said stove, said stove-top guard comprising:

a. plurality of spaced, generally L-shapped mounting brackets each of which has an upper, vertically oriented, rail-supporting leg and a horizontally oriented lower leg, said horizontally oriented lower leg being adapted for detachable connection of said brackets to said stove top;

b. at least one horizontal guard rail secured to said upper legs of said brackets, said lower legs of said brackets being capable of being secured to said stove top, said guard rail extending the length of said front side of said stove-top; said upper legs of said brackets and said guard rail arranged and dimensioned to project above the top surface of said stove-top; and c. said guard rail having a cross-sectional profile with an upper end and a lower end and an air flow passage therein extending from an entrance in the lower end of the rail to an exit in the upper end thereof; whereby cooling air will enter the passage at the lower end and exit the passage at the upper end thereof.

2. A stove-top guard according to claim 1 wherein said guard rail cross-sectional profile is wave-shaped and the entrance and exit of the air flow passage therein are positioned on a side of said guard rail which is opposite the side of said guard rail which is attached to said bracket.

3. A stove-top guard according to claim 1 including a plurality of parallel, horizontally extending wire members secured to said upper legs of said brackets on a side thereof opposite that to which the guard rail is connected.

4. A stove-top guard according to claim 3 wherein wire members and selected portions of said mounting brackets are provided with a coating of non-heat conducting material.

5. A stove-top guard adapted for connection to a top portion of a stove along at least an outer front side of said stove, said stove-top guard comprising:

a. a plurality of spaced, generally L-shaped mounting brackets each of which has an upper, vertically oriented, rail-supporting leg and a horizontally oriented lower leg, said horizontally oriented lower leg being adapted for detachable connection of said brackets to said stove top;

b. at least one horizontal guard rail secured to said upper legs of said brackets, said lower legs of said brackets being capable of being secured to said stove top, said guard rail extending the length of said front side of said stove-top; said upper legs of said brackets and said guard rail arranged and dimensioned to project above the top surface of said stove-top;

c. said guard railing having a cross-sectional profile with an upper end and a lower end and an air flow passage therein extending from an entrance in the lower end of the rail to an exit in the upper end thereof; the entrance and exit of said air flow passage facing away from the upper legs of said brackets to which said guard rail is secured whereby cooling air will enter the passage at the lower end and exit the passage at the upper end thereof; and d. a plurality of parallel extending wire members secured to said upper legs of said brackets on the side opposite that to which the guard rail is connected, said wire members and selected portions of said mounting brackets being coated with a non-heat conducting material.

* * * * *

UNITED STATES PATENT AND TRADEMARK OFFICE

CERTIFICATE OF CORRECTION

PATENT NO. : 5,450,840

DATED : Sep. 19, 1995

INVENTOR(S) : Anthony B. Kozdas

It is certified that error appears in the above-identified patent and that said Letters Patent is hereby corrected as shown below:

At column 8, line 14, before the asterisks insert the following claim:

--- 6. A stove-top guard according to Claim 1 wherein said guard rail is hollow. ---

Signed and Sealed this

Sixteenth Day of January, 1996

Bruce Lehman

*Attest:*

BRUCE LEHMAN

*Attesting Officer*

*Commissioner of Patents and Trademarks*